United States Patent [19]

Fast

[11] Patent Number: 5,042,184

[45] Date of Patent: Aug. 27, 1991

[54] SLOTTED ANGLE LABEL HOLDER

[76] Inventor: Jacob Fast, 7561 NW. 9th St., Plantation, Fla. 33317

[21] Appl. No.: 420,593

[22] Filed: Oct. 12, 1989

[51] Int. Cl.[5] ..... G09F 3/08

[52] U.S. Cl. ..... 40/663; 40/642

[58] Field of Search ..... 40/642, 489, 622, 628, 40/663, 668, 124.1, 657

[56] References Cited

U.S. PATENT DOCUMENTS

| | | | |
|---|---|---|---|
| 1,159,735 | 11/1915 | Beers | 40/642 |
| 1,294,595 | 2/1919 | Allen | 40/663 |
| 4,477,048 | 10/1984 | Conway | 40/642 |
| 4,531,313 | 7/1985 | Fast . | |
| 4,537,821 | 8/1985 | Fast . | |
| 4,539,766 | 9/1985 | Fast . | |
| 4,546,943 | 10/1985 | Fast . | |
| 4,564,548 | 1/1986 | Fast . | |
| 4,694,596 | 9/1987 | Fast . | |
| 4,703,570 | 11/1987 | Fast . | |
| 4,713,899 | 12/1987 | Fast | 40/642 |
| 4,718,627 | 1/1988 | Fast . | |
| 4,754,563 | 7/1988 | Fast . | |
| 4,779,367 | 10/1988 | Fast . | |
| 4,786,083 | 11/1988 | King | 40/642 |

*Primary Examiner*—Jose V. Chen
*Assistant Examiner*—James M. Gardner
*Attorney, Agent, or Firm*—Fleit, Jacobson, Cohn, Price, Holman & Stern

[57] ABSTRACT

A label holder for use on a slotted angle member is in the form of a substantially rectangular plastic sheet having half-moon shaped depressible tabs at its opposite side edges. In use the tabs are pushed through respective slots of the angle member and the arcuate edges promote squeezing and compression of the tabs in the slots. The tabs are twisted behind the slots to secure the holder against the angle member. The tabs are defined as cuts at the opposite sides of the holder.

7 Claims, 1 Drawing Sheet

SLOTTED ANGLE LABEL HOLDER

BACKGROUND AND SUMMARY OF THE INVENTION

This invention relates to a label holder particularly but not exclusively intended for use on a slotted angle iron, or the like, of the type frequently used, for example in warehouses and the like for constructing storage racks or shelves.

A typical elongate slotted angle iron has perpendicular flanges each of which is formed with a row or rows of slots or other apertures which may be used, for example, to receive mechanical fastener elements and the like for attaching angle irons together and to other elements in the construction of warehouse shelves, racks, and the like. The slots may take the form, for example, of substantially oval-shaped apertures aligned longitudinally and/or laterally with respect to the relevant flange of the angle iron. Depending on the angle iron design, the slots may be variously oriented and configured and may be interspersed at intervals with circular or other shape apertures.

It is an object of the invention to provide a simple and convenient form of label holder which can be releasably secured to an angle iron of the above type for attaching an adhesive or nonadhesive label to the angle iron without the label holder itself being secured thereto by adhesive. Another object of the invention is to provide a label holder of the above type which can be used, removed, and reused on an angle iron as required.

In accordance with the invention, therefore, there is provided a label holder for the purpose indicated comprising a generally rectangular sheet of plastic material having depressible tabs at the sides thereof spaced apart at a distance conforming to the distance between a selected pair of apertures in a slotted angle member. The configuration of the tabs is such that with the label holder applied face to face against the flange of an angle iron and with the tabs positioned over the respective pair of apertures, each tab can be depressed into a respective aperture by means of a pencil, screwdriver, or like elongate object, pushed through the aperture and then rotated back behind the aperture to secure the label holder to the angle iron. The size and shape of each tab should be such that it is squeezed and flexed to an extent as it is pushed through the respective aperture so that it will be retained therein by friction.

To remove the label holder, the tab may be pinched or flexed from behind in order to allow the tab to be pulled back out through the aperture.

In a preferred form of the invention, for example, each tab may have arcuate edges extending oppositely from a neck portion of the tab by which it is secured to the body of the label holder. The arcuate edges promote the proper flexing and compression of the tab as it is pushed through the aperture with an elongate article such as a pencil.

The arcuate edges may be defined by cutouts at opposite sides of the holder body so that the tabs themselves are effectively formed in the body of the holder and do not project from its opposite edges.

DESCRIPTION OF PREFERRED EMBODIMENT

Figure 1:
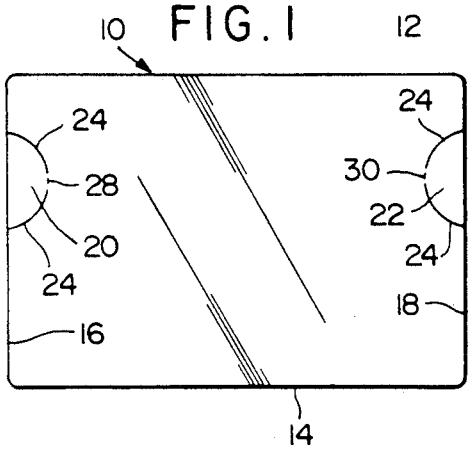
FIG. 1 is an elevational view of a label holder according to the invention.
Figure 2:
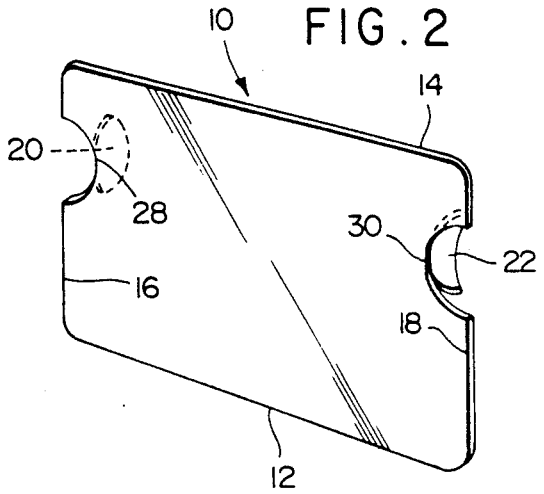
FIG. 2 is a perspective view of the label holder with depressed tabs.

Referring initially to FIG. 1, there is shown therein a generally rectangular label holder 10 which may, for example, be die cut from sheet plastic of a type well known for such label holders. The label holder has upper and lower edges 12 and 14 and side edges 16 and 18. Along the side edges and towards the upper edge 12, the label holder is provided at the opposite edges 16 and 18 with a pair of generally half-moon shaped depressible tabs 20 and 22. Each tab is defined by respective part circular slits or cuts 24 extending from the respective edge 16 or 18 of the holder to a central land or neck portion 28 or 30 by which the respective tab remains secured to the main body of the holder 10. It will be evident from FIG. 2 that the tabs 20 and 22 may be depressed rearwardly from the main body of the holder as shown.

Figure 3:
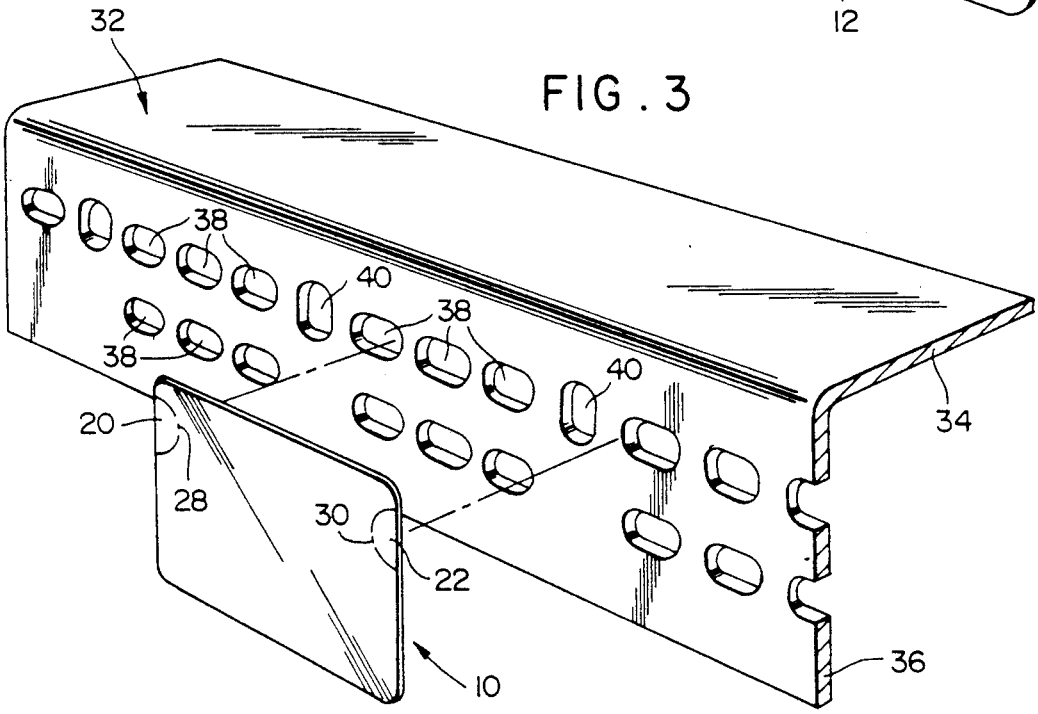
FIG. 3 is a perspective view of a slotted angle iron and label holder in accordance with the invention.
Figure 4:
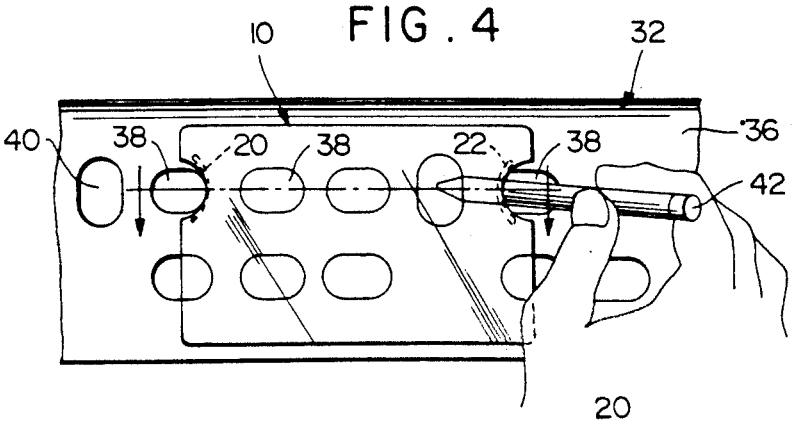
FIG. 4 is a front elevational view of the angle iron showing the manner of attachment of the label holder.
Figure 5:
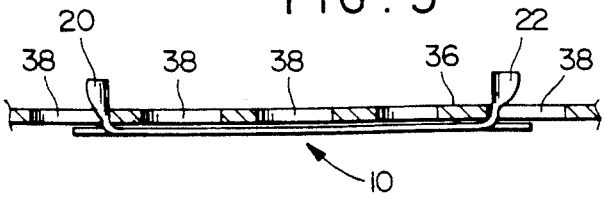
FIG. 5 is a sectional view on line 5—5 of FIG. 4.

Holder 10 is designed primarily for use in conjunction with angle irons such as that shown at 32 in FIGS. 3–5. The angle iron is of a well known type having respective perpendicular flanges 34, 36 and is used, for example, in constructing warehouse racks, shelving or the like by securement to other angle irons, shelving elements and the like. In the illustrated angle iron, the flange 36 has two rows of substantially oval apertures 38 aligned longitudinally along the flange and the upper row of apertures are interspersed with laterally aligned oval shaped apertures 40. The holder 10 is shaped and configured such that the tabs 20 and 22 will substantially align with pairs of apertures 38 in the upper row which are separated by three other apertures and also such that when so aligned, the upper and lower edges of the holder will be symmetrically disposed with respect to the upper and lower edges of flange 36. It is for this reason that the tabs 20 and 22 are provided towards the upper edge 12 of the holder.

With the holder aligned in the above described manner, and as shown more particularly in FIG. 4, the tabs 20 and 22 may be depressed rearwardly and pushed through the respective apertures 38 using a pencil 42 or other elongate instrument. In this operation, the arcuate edges 24 of the tabs promote squeezing or compression of the tab, noting that the original height of the tab is greater than the equivalent height of aperture 38. Accordingly, when the tab is squeezed through the aperture by means of pencil 42, it will be retained therein by friction. Thus, there is provided a simple and convenient means for securely retaining the holder 10 on the flange 36 of the angle iron. The holder 36 may itself carry labeling or may be used with an adhesive or nonadhesive label.

The tabs 20 and 22 may vary in shape from those described, and also they may be formed as projections at the opposite edges of the holder rather than cutouts in the body of the holder itself.

While only a preferred embodiment of the invention has been described herein in detail, the invention is not limited thereby and modifications can be made within the scope of the attached claims.

I claim:

1. A label holder for use on a slotted angle member, said holder comprising a sheet of flexible material having upper, lower and opposite side edges and a depressible tab at each side edge between the upper edge and the lower edge, said tab comprising convex arcuate edge portions extending inwardly from the respective side edge to a neck portion substantially centrally disposed with respect to the tab and by which neck portion the tab is joined to a body portion of the holder.

2. A holder as defined in claim 1 wherein each tab has a substantially linear edge portion connecting said arcuate portions opposite the neck portion whereby the tab has a substantially half-moon shape.

3. A holder as defined in claim 1 wherein the arcuate portions are defined by cuts extending from the opposite side edges of the holder and wherein said arcuate portions are connected by respective edge portions opposite the respective neck portions, said edge portions being coextensive with the respective side edges of the holder.

4. A holder as defined in claim 1 wherein the tabs are positioned more closely to the upper edge than to the lower edge.

5. In combination, an elongate angle member having at least one flange formed with a row of apertures, and a label holder arranged face to face with said flange said holder comprising a sheet of flexible material having upper, lower and opposite side edges and a depressible tab at each side edge between the upper edge and the lower edge, said tab comprising convex arcuate edge portions extending inwardly from the respective side edge to a neck portion substantially centrally disposed with respect to the tab and by which neck portion the tab is joined to a body portion of the holder and with said tabs aligned with respective ones of the apertures, the tabs being pushed through the apertures, squeezed into a compressed state by engagement of said arcuate edge portions with respective edges of the apertures, and twisted behind the flange to secure the holder thereon.

6. The invention as defined in claim 5 wherein the arcuate edge portions are defined by cuts extending inwardly from the respective side edges of the holder.

7. The invention as defined in claim 5 wherein said row of apertures is located more closely to one elongate edge of the flange than to an opposite elongate edge of the flange and said tabs are correspondingly located more closely to an upper edge of the holder than to a lower edge of the holder.

* * * * *